US005248003A

United States Patent [19]

Song et al.

[11] Patent Number: 5,248,003

[45] Date of Patent: Sep. 28, 1993

[54] APPARATUS AND METHOD FOR SUPPORTING THE FREE END OF A CANTILEVER BEAM OF A CANTILEVERED JACK-UP RIG

[75] Inventors: Kun K. Song, New Orleans; Ray A. Smith, Slidell; Carmon R. Costello, Kenner, all of La.

[73] Assignee: Ocean Drilling & Exploration Company, New Orleans, La.

[21] Appl. No.: 749,118

[22] Filed: Aug. 23, 1991

[51] Int. Cl.[5] ..... E21B 7/136

[52] U.S. Cl. ..... 175/9; 405/198; 405/226

[58] Field of Search ..... 175/9, 8, 7; 405/201, 405/196, 198, 226

[56] References Cited

U.S. PATENT DOCUMENTS 3,477,235 12/1967 Branham et al. ..... 175/9
4,483,644 11/1984 Johnson ..... 405/201
4,583,881 4/1986 Steele ..... 405/198
4,739,840 4/1988 Cox ..... 175/9
4,973,198 11/1990 Cox ..... 405/201
5,032,040 7/1991 Ingle ..... 405/201

*Primary Examiner*—Ramon S. Britts
*Assistant Examiner*—Frank S. Tsay
*Attorney, Agent, or Firm*—Stephen R. Doody

[57] ABSTRACT

A cantilevered jack-up rig having a support for supporting the free ends of the rig's cantilever beams when said beams are extended over a platform to be serviced by the rig, thereby maximizing the lateral reach of the rig and increasing the load capacity at the maximized reach. The support is positioned between the top of the platform and the bottoms of the extended cantilever beams. The top of the support is provided with a motion block to facilitate lateral and rotational motion of the extended cantilever beams relative to the support.

9 Claims, 12 Drawing Sheets

APPARATUS AND METHOD FOR SUPPORTING THE FREE END OF A CANTILEVER BEAM OF A CANTILEVERED JACK-UP RIG

FIELD AND BACKGROUND OF THE INVENTION

The present invention relates generally to a mobile marine structure of the type having a floatable hull which can be jacked up on the legs of the structure so as to serve as a stable working deck, said deck being provided with movable cantilever beams for supporting drilling and other equipment thereon at a location outside the periphery of the deck. Commonly referred to as "cantilevered jack-up rigs", such structures are often used to drill or service wells which are associated with and located near fixed production platforms.

Fixed production platforms, hereinafter "platforms", are generally erected to facilitate the production and transmission of oil and gas from wells that have already been successfully drilled. Many platforms are not equipped with the heavy machinery necessary to drill new wells or service existing wells. Hence, if it becomes necessary to service the existing wells of such a platform, or if it is desireable to drill new wells so as to enhance the production to the platform, the necessary servicing and drilling equipment must be brought to the platform site.

Such drilling and servicing equipment is sometimes provided in the form of a platform drilling rig. A platform drilling rig is typically comprised of several large, heavy and unitized packages, including a drilling unit, engine unit, crew quarters unit, mud pump units, liquid mud storage unit, drilling water storage unit and bulk material storage unit. In use, the unitized packages of a platform drilling unit are transported to the platform via a barge. The units are transferred from the barge to the platform, and the drilling and servicing operations are then conducted from the platform. When the operations have been completed, the unitized packages are transferred from the platform back to the derrick barge.

There are several disadvantages associated with the above described use of a platform drilling rig, including the need for a relatively large amount of deck area on the platform. Not all platforms have a deck area which is big enough to accommodate the large and numerous unitized packages of the platform drilling rig. Additionally, the installation of a platform rig is a very time consuming and costly process. Moreover, the heavy unitized packages of the platform drilling rig impose a tremendous vertical load on the fixed production platform which may exceed or come dangerously close to the platform's design load capacity.

As an alternative to the use of a platform drilling rig for the above described purposes, a cantilevered jack-up rig is sometimes employed. In use, a cantilevered jack-up rig, with its hull floating in the water, is self-propelled, towed or otherwise moved to the location of the subject platform and is positioned as close to the platform as is operationally required. The legs of the cantilevered jack-up rig are then lowered to the seabed and the hull is jacked up on the legs, out of the water and above the reach of the sea waves, where it serves as a stable work deck from which well drilling, servicing and other activities can be conducted.

The hull/deck of the cantilevered jack-up rig is typically equipped with and provides support for a pair of cantilever beams which may be skidded or otherwise moved laterally with respect to the hull/deck. Such lateral movement of the beams is typically in a longitudinal direction, i.e., forward and aft. The cantilever beams support and laterally transport drilling and servicing equipment, including a derrick. After the hull/deck of the cantilevered jack-up rig has been jacked up a suitable height above the water, the cantilever beams are skidded laterally across the hull/deck such that the unsupported or "free" ends of the cantilever beams, with the derrick supported thereon, extend laterally beyond the periphery of the hull/deck. From such a cantilevered position, the derrick can service and/or drill the wells associated with the platform, including wells located directly below the platform.

The cantilevered jack-up rig has an advantage over the platform drilling rig in that the former does not involve the placement of any equipment onto the platform. Therefore, the use of a cantilevered jack-up rig is not limited by the space and weight considerations which apply to the use of a platform drilling rig.

However, the cantilevered jack-up rig has other limitations which detract from its usefulness. More specifically, the vertical load capacity of the free end of the cantilever beam reduces in proportion to its unsupported length. Hence, there is a practical limitation on the lateral extension or "reach" of the cantilever beams and the equipment they support. Due to such reach limitation, a cantilevered jack-up rig may be unable to service or drill all of the desired platform wells from a single position. In order to service or drill such "unreachable" wells, the operations of the cantilevered jack-up rig must be interrupted so that the hull/deck can be jacked down to the water, the legs raised from the seabed and the entire rig moved to a new position from which the previously "unreachable" wells may be reached. Such interruption of operations and movement of the cantilevered jack-up rig are very expensive, time consuming and may not be practically possible.

Several attempts have been made to deal with the problems associated with the limited accessibility and reduced beam load capacity of cantilevered jack-up rigs. For example, U.S. Pat. No. 4,973,198, issued to Cox, discloses a method and apparatus for transferring a drilling derrick from a jack-up rig to a fixed platform. According to Cox, the fixed platform is provided with a removable upper platform section having a suitable size to accommodate the drilling derrick to be positioned thereon. The removable upper platform is provided with a series of power jacks or other hoisting mechanisms such that the upper platform section becomes a leveling unit which is maintained in an appropriate horizontal alignment with the jack-up drilling rig.

One of the obvious disadvantages with Cox is that it requires a potentially huge investment of time and money in order to install the upper platform section onto the fixed production platform. Another problem with Cox it that it involves the imposition of the entire weight of the drilling derrick onto the fixed production platform.

Another attempt at solving the general problem is disclosed in U.S. Pat. No. 4,938,628, issued to Ingle. Ingle discloses an apparatus and method for transferring a drilling module from a jack-up rig to a fixed platform. The jack-up rig is provided with a cantilever beam assembly which supports a drilling module. The cantilever beam assembly, with its supported drilling module, is extended to a position over the fixed platform. The hull of the jack-up rig is then jacked down until the drilling module rests on the fixed platform, allowing the cantilever beam assembly to then be withdrawn and returned to the jack-up rig. Whatever its merits, Ingle does not solve the problem associated with transferring the entire vertical load of the drilling module onto the fixed platform.

SUMMARY OF THE INVENTION

The object of the present invention is to provide a cantilevered jack-up rig having a maximized reach capability and increased load capacity at the maximized reach. According to the invention, means are provided to support the free ends of the cantilever beams on the fixed platform. In operation, the cantilever beams with the support means suspended therefrom are extended outwardly and over the deck of the platform. The support means is lowered and secured on the platform.

The cantilever beams are then further extended until the derrick is over the well to be serviced or drilled. The hull of the cantilevered jack-up rig is then jacked down, until the bottom of the cantilever beams come to rest on the support means. The top of the support means is provided with a motion block, including skid and swivel pads, to facilitate further skidding of the cantilevered beams across the top of the support means, and to allow lateral and rotational movement of the cantilever beams relative to the support means.

DESCRIPTION OF THE PREFERRED EMBODIMENTS

Figure 1:
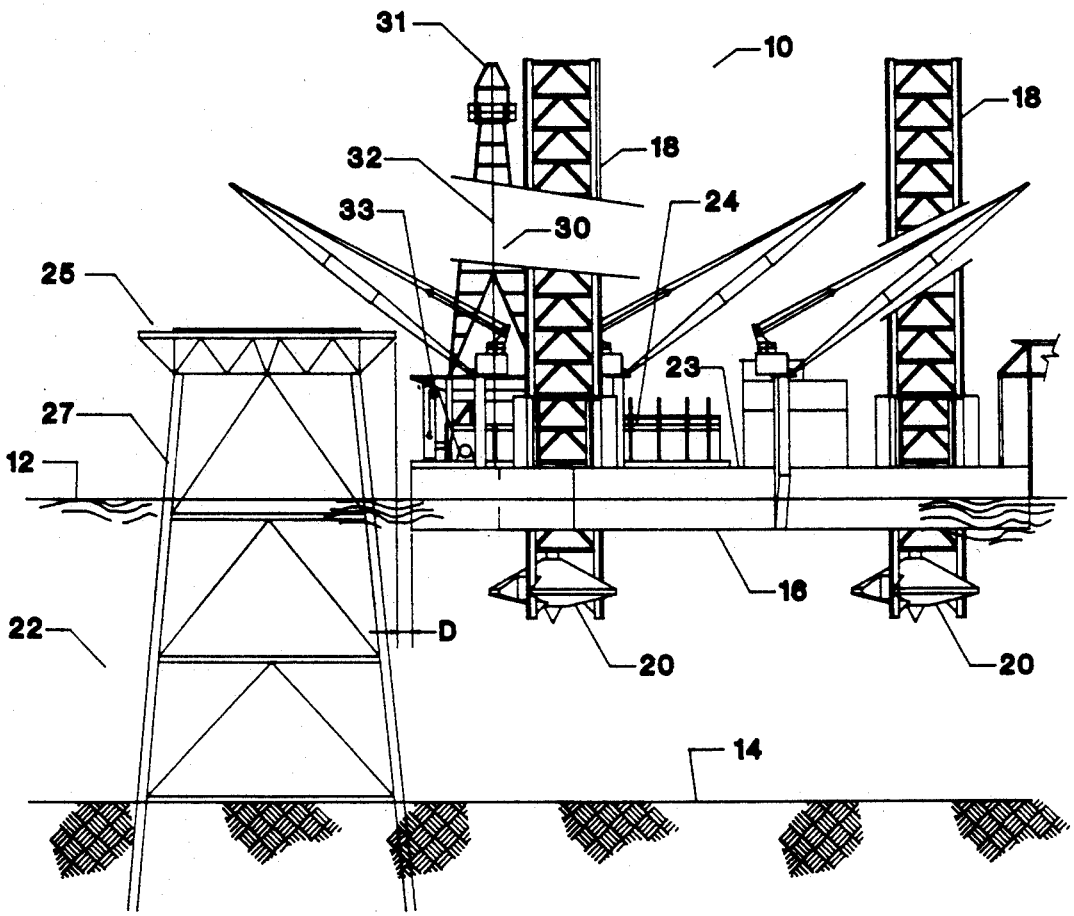
FIG. 1 is a side elevation of a cantilevered jack-up rig in accordance with the present invention shown in a floating position adjacent to a fixed platform.

The objects and advantages of the present invention are achieved through the provision of a mobile marine structure, as for example the cantilevered jack-up drilling rig (hereinafter "rig") generally depicted as 10 in FIG. 1, shown floating on the surface 12 of a body of water having a seabed 14. Rig 10 includes hull 16 which is capable of floating on the surface of the water as shown in FIG. 1.

Extending from hull 16 are supporting legs 18, shown in FIG. 1 near their uppermost position. Said legs are capable of movement up and down with respect to the hull, said movement being accomplished by any of several known means, such as toothed racks attached to the legs for engagement with rotatable gears mounted on the hull, or by a system of hydraulic jacks. In the preferred embodiment of the invention, the lower end of each leg 18 is provided with a support footing 20.

Figure 2:
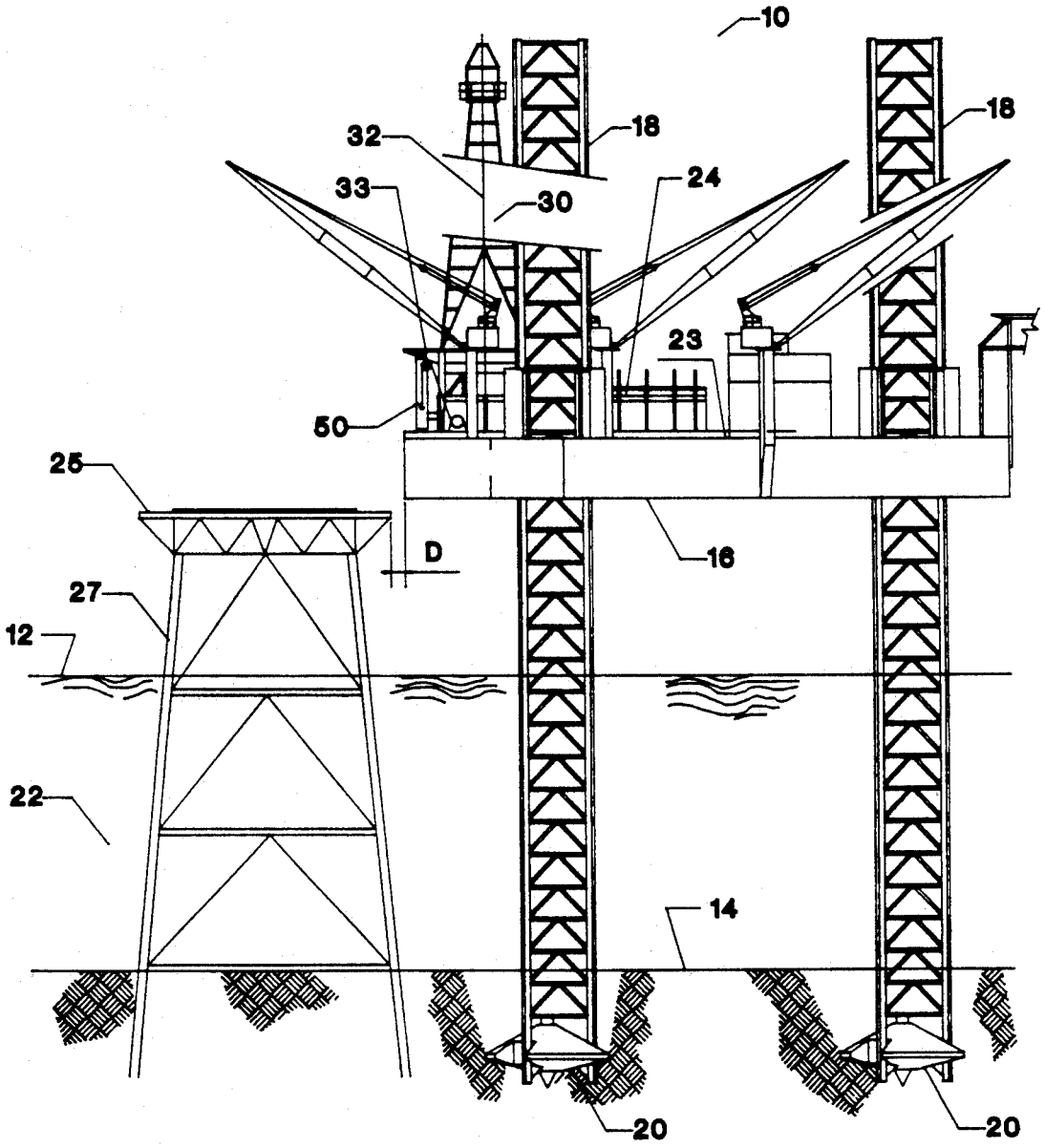
FIG. 2 is second view of the cantilevered jack-up rig illustrated in FIG. 1 shown in its jacked-up position.
Figure 11:
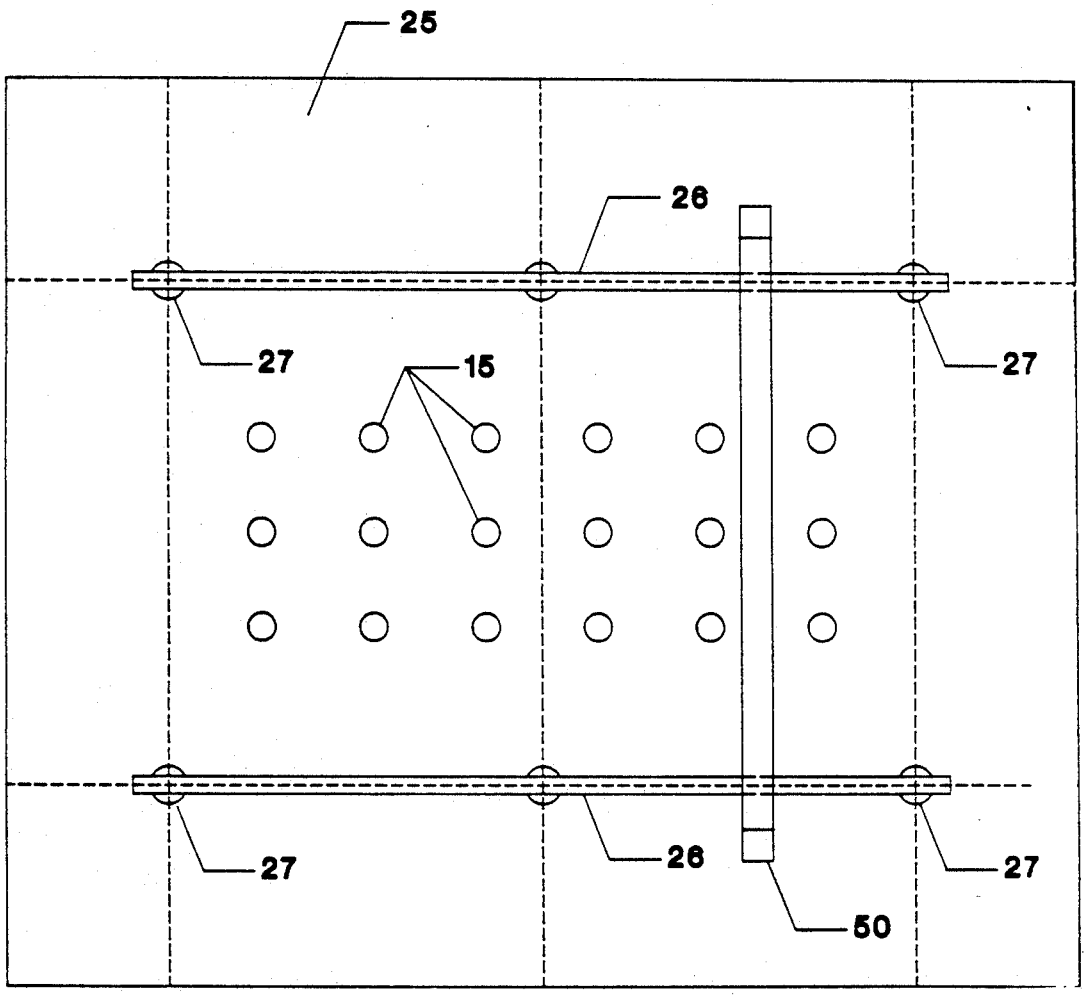
FIG. 11 is plan view of a typical platform deck showing the relative position thereon of the support means of the present invention.

During movement of the rig 10 across the water, said rig is maintained in the general configuration shown in FIG. 1. The rig may be self-propelled, towed or otherwise maneuvered to a desired location near a fixed production platform having wells to be serviced or drilled by the rig, such as platform 22 shown in FIG. 1, situated above wells 15 as shown in FIG. 11. After rig 10 has been maneuvered within an operationally acceptable distance "D" of the platform 22, legs 18 are lowered so that support footings 20 at the bottom ends of the legs become engaged with the seabed, as shown in FIG. 2. Hull 16 is then jacked up on legs 18 a sufficient distance above the water surface 12 so as to provide a stable working deck which is substantially free from the effects of sea waves.

The surface deck 23 of hull 16 is equipped with and provides support for a pair of cantilevered beams 24 which may be skidded or otherwise moved laterally with respect to hull 16. Such skidding or lateral movement of cantilever beams 24 is accomplished by any of several known means, such as a system of hydraulic jacks or an assemblage of gears.

Cantilever beams 24 support and transport a drilling module generally designated as 30 in FIG. 1. Drilling module 30 includes drilling derrick 31, said derrick having a center line 32, and drilling floor 33. The weight of drilling module 30 is transferred to cantilever beams 24 by way of substructure 34, best shown in FIG. 3. Substructure 34 includes horizontal framing members 34H, vertical framing members 34V and diagonal framing members 34D.

Figure 3:
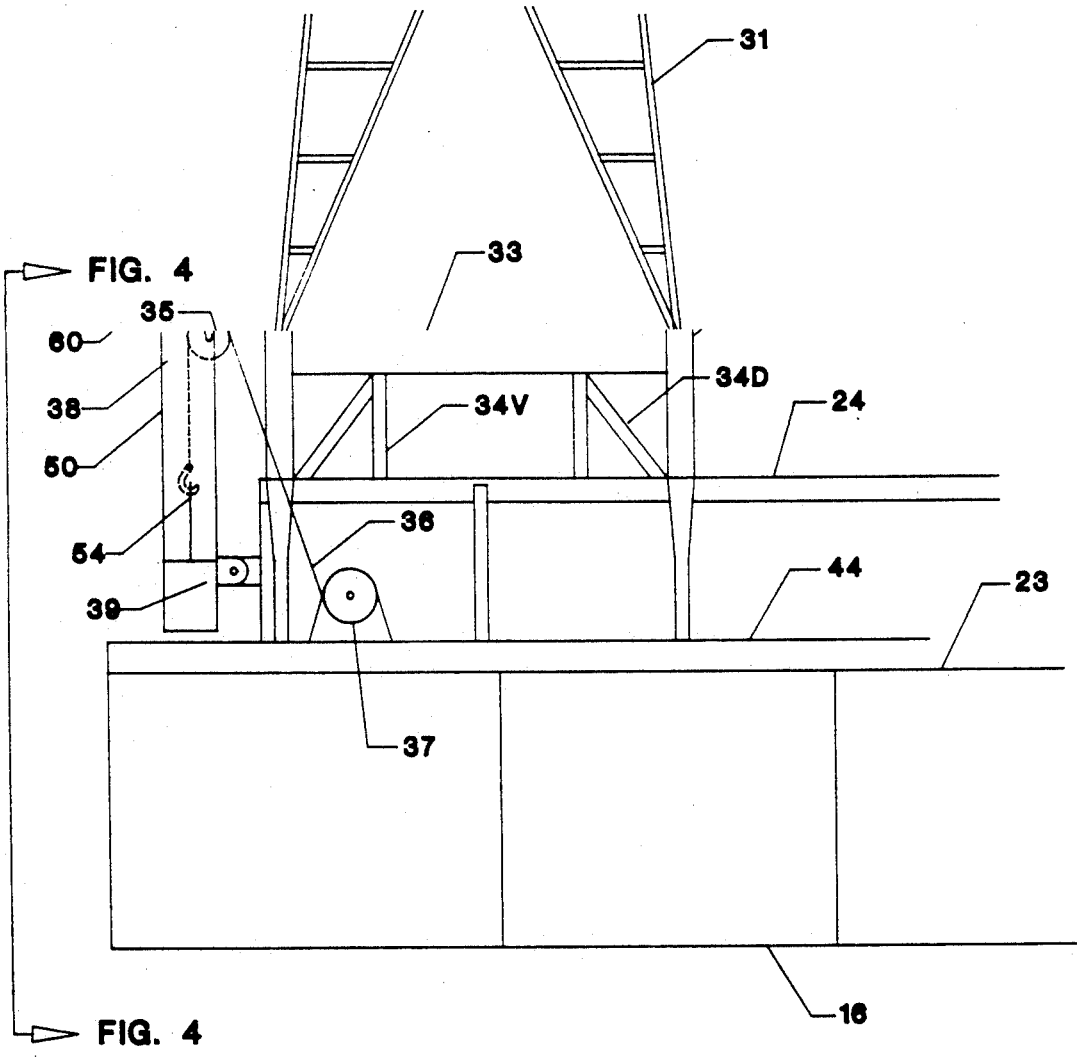
FIG. 3 is an enlarged, partial side elevation of the cantilevered jack-up rig illustrated in FIG. 1 showing cantilever beams and support means in the stowed position.
Figure 4:
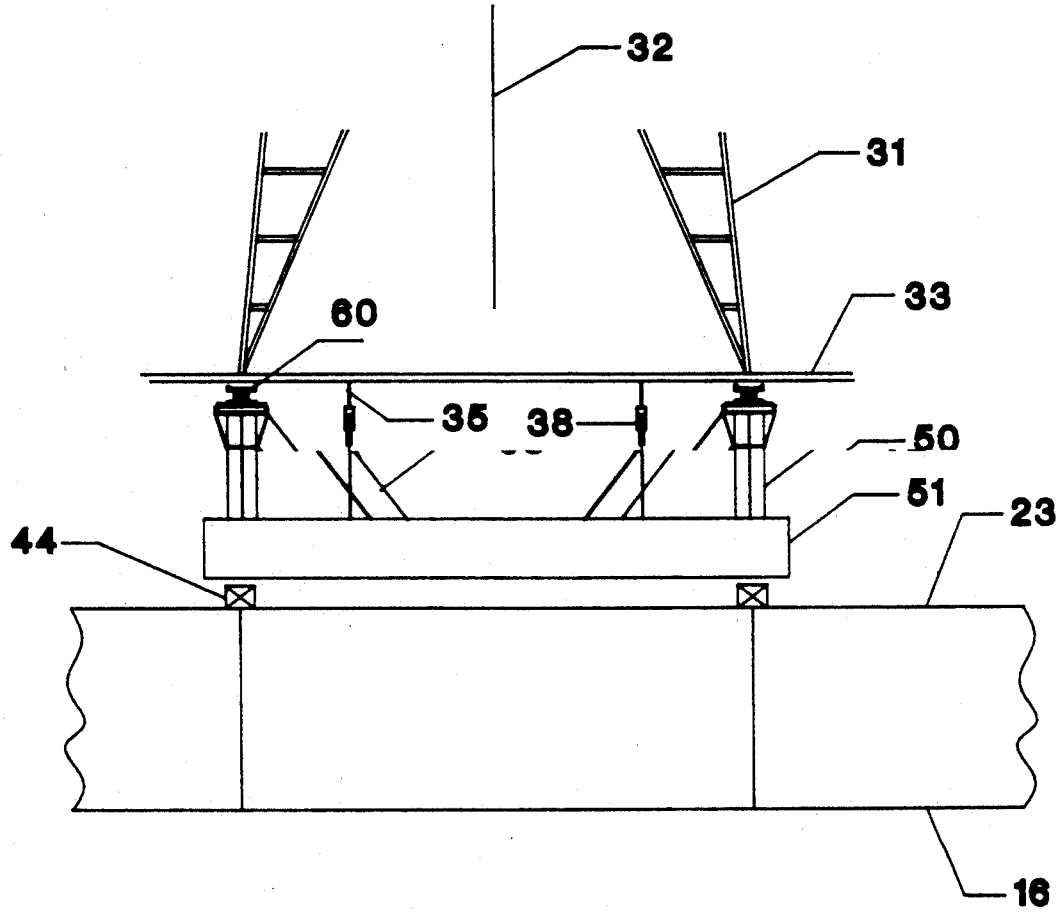
FIG. 4 is a rear elevation taken along line 4—4 of FIG. 3.
Figure 5:
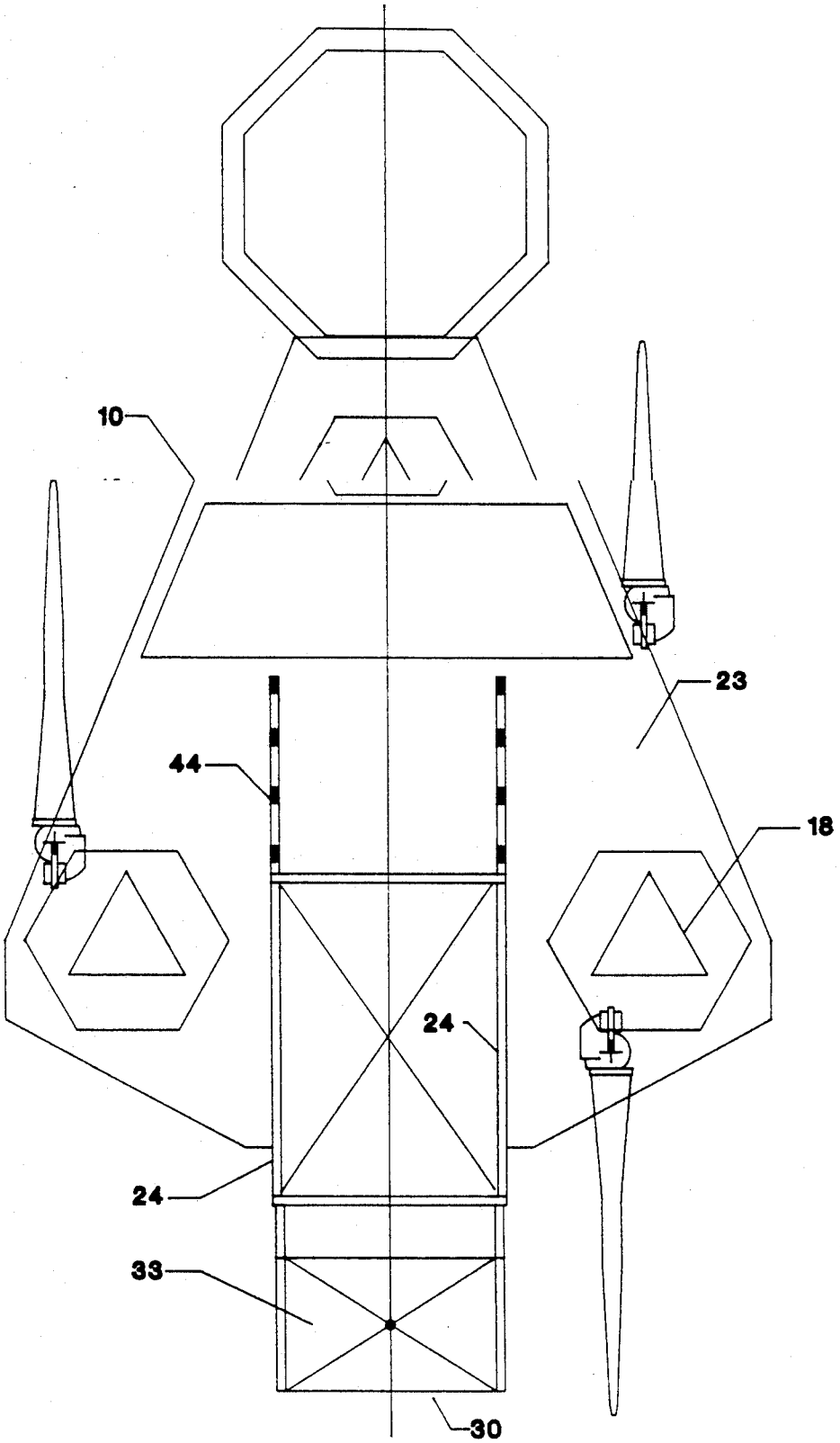
FIG. 5 is a plan view of a cantilevered jack-up rig in accordance with the present invention shown with its drilling module supported on cantilever beams which have been extended beyond the periphery of the rig's hull.

In the preferred embodiment of the invention, cantilever beams 24 are aligned with and skid upon skid tracks 44, which are located on hull 16, as best shown in FIGS. 3 and 5. Thus, lateral movement of cantilever beams 24 is preferably in a longitudinal direction, i.e., forward and aft, with respect to hull 16. Substructure 34 may be skidded or otherwise moved laterally across the top of cantilever beams 24. The drilling derrick 31 may be skidded or otherwise moved laterally with respect to the substructure 34, preferably in a transverse, i.e., side-to-side direction with respect to hull 16.

While the rig 10 is undergoing movement from one location to another, the cantilever beams 24 are maintained in a stowed or retracted position, as shown in FIG. 1. When there is a need to use the drilling module 30 of the rig, hull 16 is jacked up out of the water and cantilever beams 24 are extended laterally and outwardly, as depicted in FIG. 6.

Figure 6:
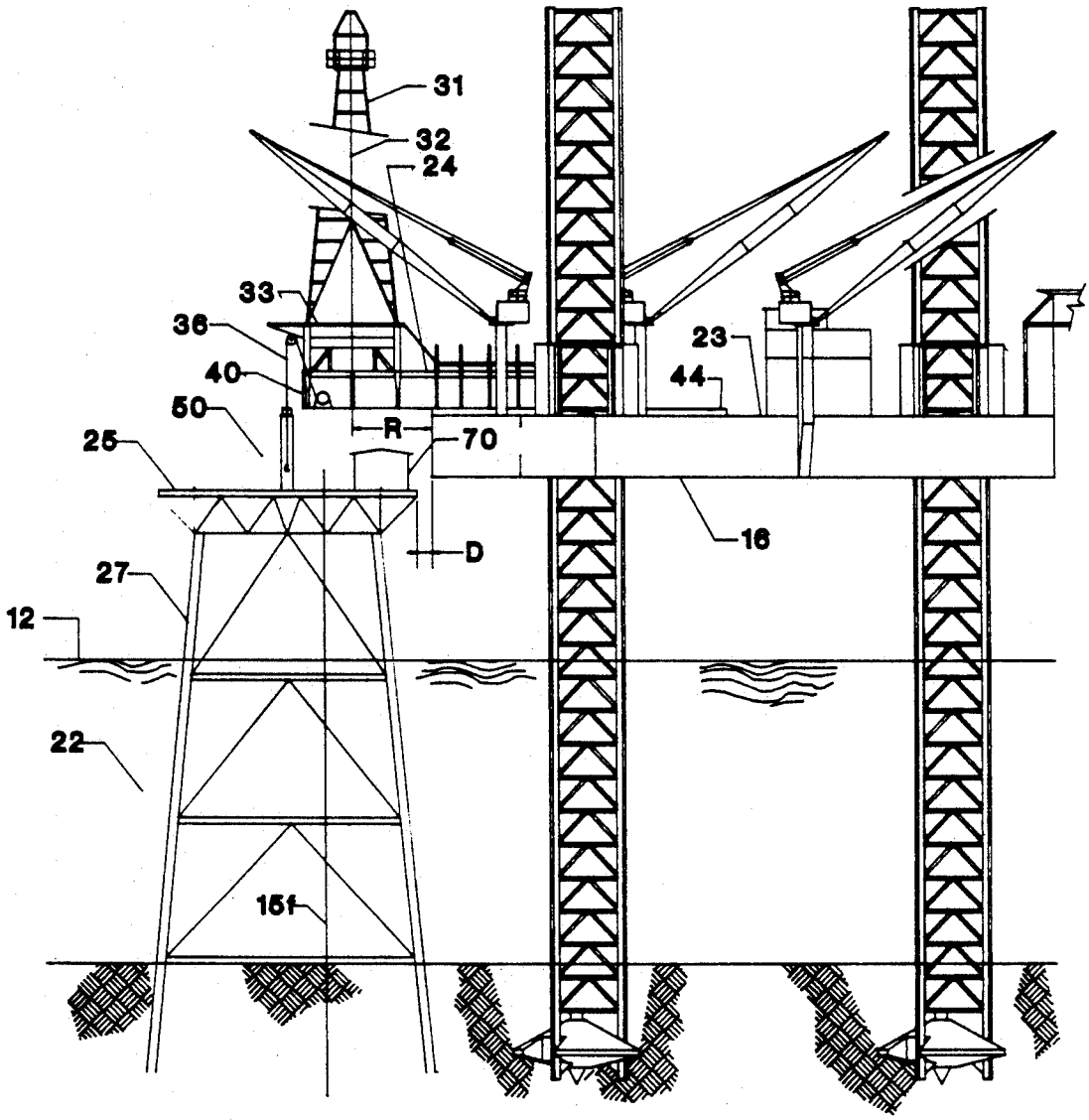
FIG. 6 is an additional view of the cantilevered jack-up rig illustrated in FIG. 2 shown with its drilling module supported on cantilever beams which have been extended over the fixed platform and further showing support means which has been lowered to the surface of the platform.

As the unsupported or "free end" 40 of cantilever beam 24 is moved outwardly to its extended position, as shown in FIG. 6, it transports substructure 34 and drilling module 30 to a location beyond the periphery of hull 16. The distance "R" between the periphery of hull 16 and the center line of drilling derrick 31 is known as the "reach" of the rig.

Figure 7:
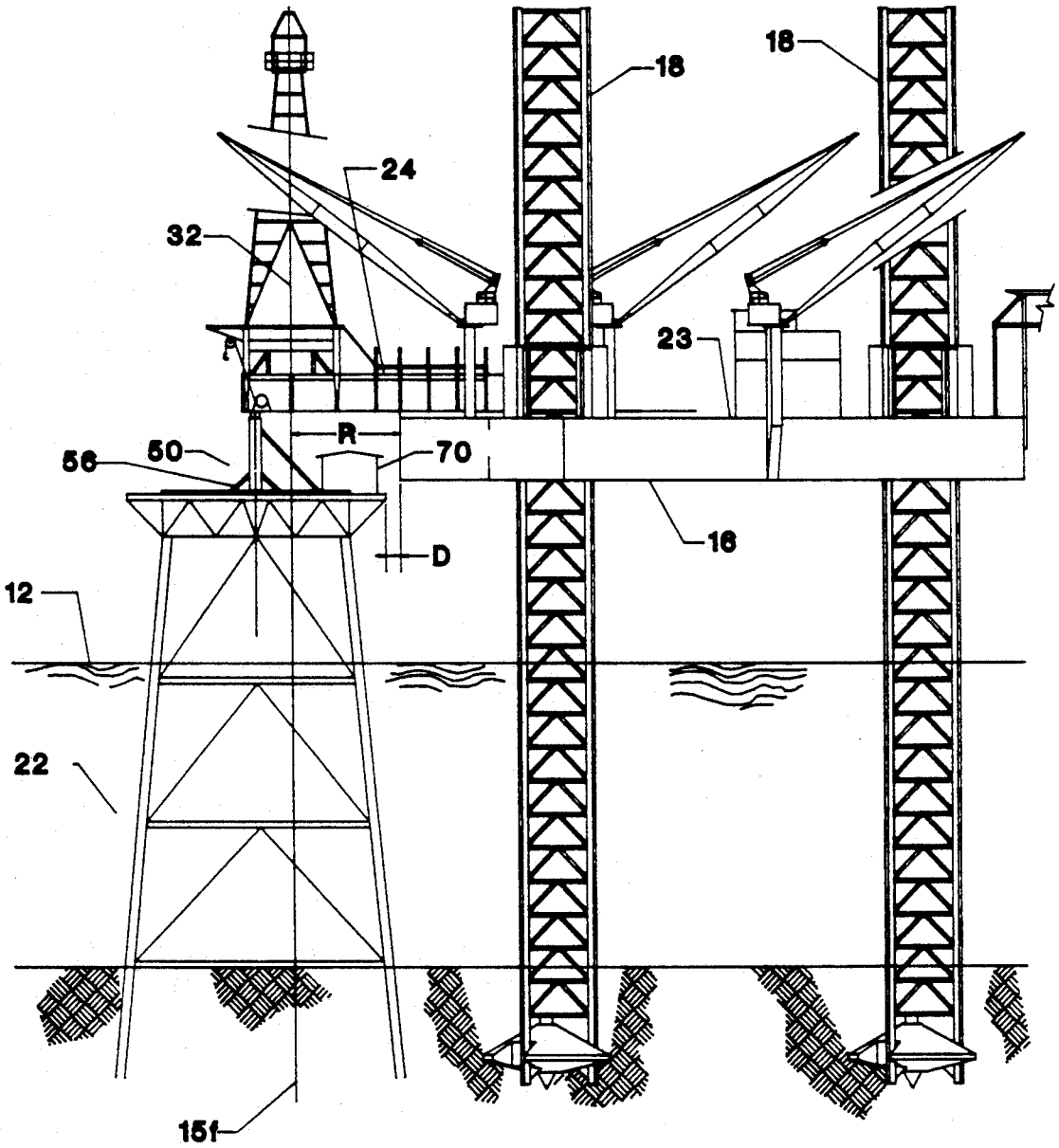
FIG. 7 is a further view of the rig illustrated in FIG. 6 shown with the support means affixed to the platform and providing support for the free ends of the cantilever beams.
Figure 8:
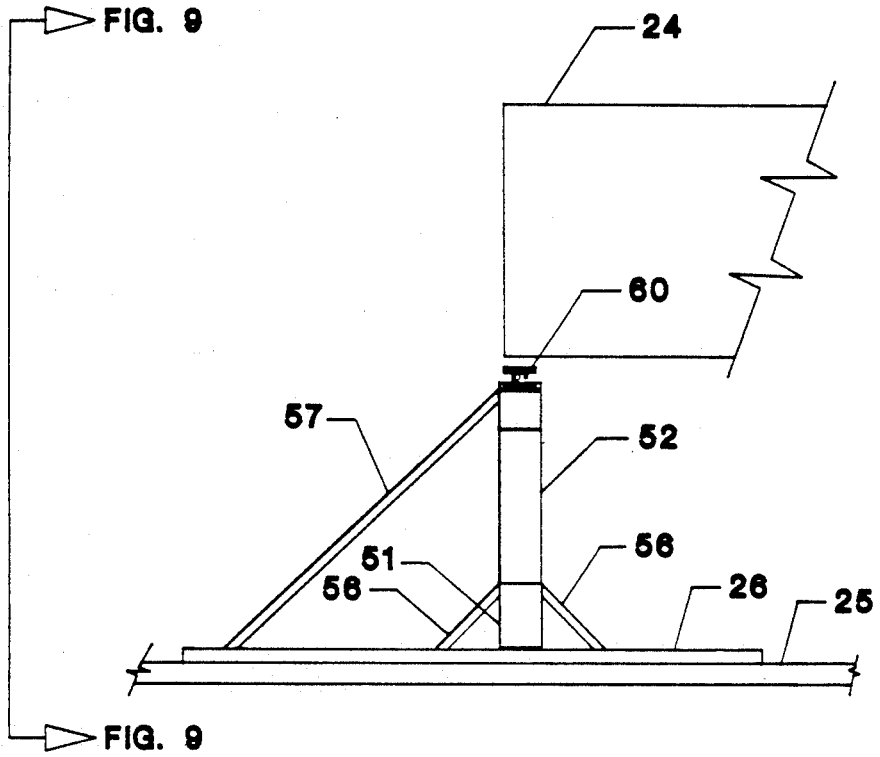
FIG. 8 is an enlarged, partial side elevation of the support means of the present invention fixed in position on top of a platform showing the relative alignment of the support means with the cantilever beams.
Figure 9:
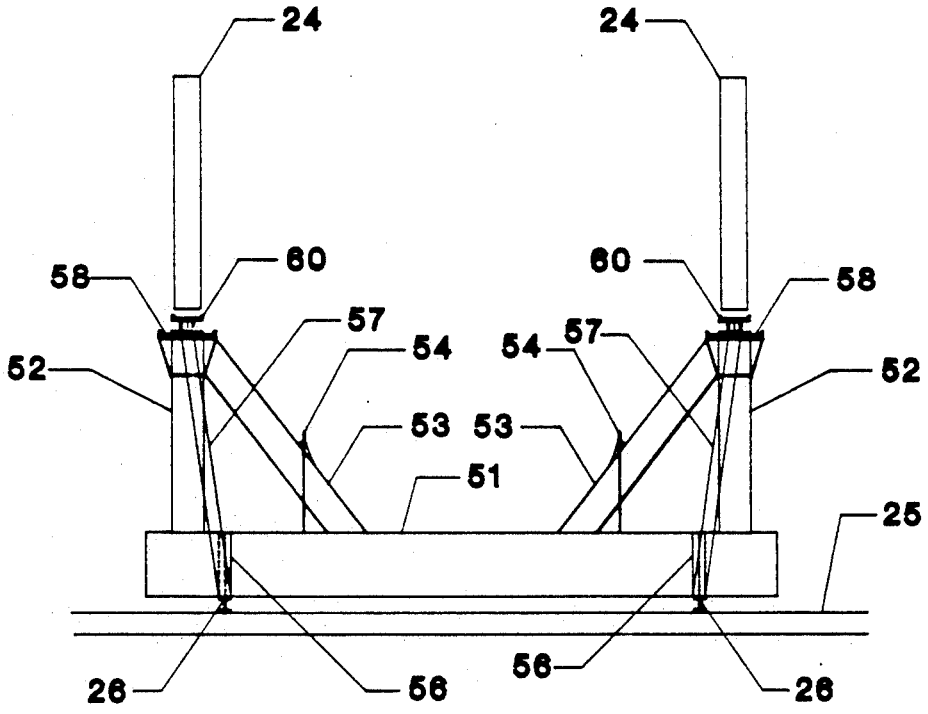
FIG. 9 is a rear elevation taken along line 9—9 of FIG. 8.

The rig of the instant invention is provided with support means 50 for supporting the cantilevered beams 24 on platform 22 when said beams have been extended laterally over the platform, as depicted in FIG. 7. In the preferred embodiment of the invention, as best shown in FIGS. 8 and 9, support means 50 includes girder 51. For use with a platform having a building 70 or similar obstruction located thereon, as depicted in FIGS. 6 and 7, support means 50 is preferably provided with at least one vertical column 52 extending upwardly from the girder, as shown in FIGS. 8 and 9. Column 52 maintains sufficient vertical clearance for beam 24 above such building 70 or other obstruction situated on the platform which might otherwise interfere with the beam.

Vertical columns 52 are preferably spaced apart on girder 51 such that the horizontal distance between the centerlines of said columns is equal to the horizontal distance between the centerlines of cantilever beams 24. Vertical columns 52 may be of a fixed height or, alternatively, may have a variable height, such height variation being accomplished by any of several well-known means, including telescoping parts which can be pinned or otherwise secured together at varying vertical positions.

In the preferred embodiment of the invention, diagonal bracing member 53 extends from the top of each vertical column 52 to girder 51, as shown in FIG. 9. Support means 50 is provided with at least one lifting eye 54 or other lifting aid, which is preferably attached to diagonal brace 53.

Figure 10:
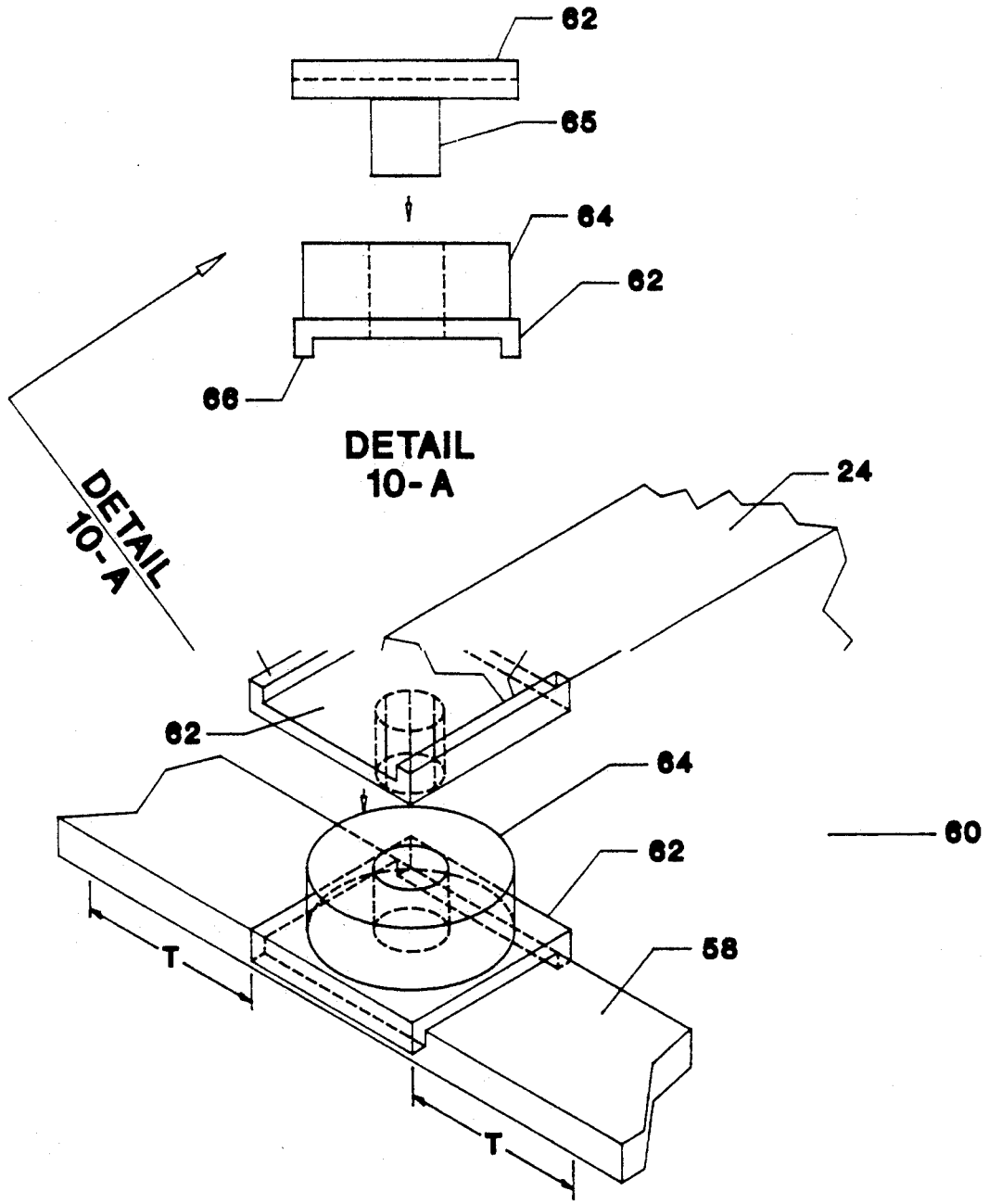
FIG. 10 is an expanded view of the motion block of the present invention.

Support means 50 is preferably provided with means for facilitating rotational motion as well as longitudinal and transverse translation of the cantilever beams relative to the support means, such as motion block 60 shown generally atop column 52 in FIGS. 8 and 9, and shown in detail in FIG. 10. Motion block 60 includes upper and lower sliding pads 62 located above and below a middle pad 64, as depicted in FIG. 10. Pads 62 and 64 are connected in such a way as to permit rotational or twisting motion between the pads, as for example by use of pivot pin 65 shown in FIG. 10. The surfaces of one or more pads 62 and 64 may be greased or equipped with ball bearings or rollers. Upper and lower sliding pads 62 are preferably provided with lips, channels or other means to prevent the beam from sliding off the support means 50, as for example lips 66 shown in FIG. 10.

When vertical clearance of beam 24 above a building or other obstruction on the platform is not required, as for example when there are no obstructions on the platform or when the obstructions are situated such that they will not interfere with the beam, support means 50 need not and preferably does not include vertical column 52. In such an embodiment of the invention, motion facilitating means 60 are preferably situated on top of girder 51 and spaced apart such that the horizontal distance between the centerlines of motion facilitating means 60 is equal to the horizontal distance between the centerlines of cantilever beams 24.

In the preferred embodiment of the invention, bottom sliding pad 62 is situated on a supporting surface 58 of support means 50 so as to permit transverse translation of beam 24, i.e., side-to-side movement of the beam as bottom sliding pad 62 slides along said supporting surface 58. When support means 50 does not include vertical columns 52, supporting surface 58 preferably comprises the upper surface of girder 51. When support means does include vertical columns 52, supporting surface 58 preferably comprises the upper surfaces of columns 52. In either case, supporting surface 58 of the preferred embodiment of the invention should be long enough so as to allow the bottom sliding pad to slide in either direction along said surface 58 a distance "T" not less than 12 inches.

When cantilever beams 24 are in their retracted or "stowed" position, as depicted in FIG. 1, support means 50 is removably secured to rig 10 in an out-of-the-way place. For example, in the preferred embodiment of the invention as depicted in FIG. 3, support means 50 is suspended from a girder 35 underlying drilling floor 33. Such suspension can be accomplished by any one of several known ways, such as the use of a suspending line 36 running from winch 37, over pulley 38 to a connecting point on the support means, such as lifting eye 54, as depicted in FIG. 3. To prevent swaying motion of support means 50 while it is thusly stowed away, it may be removably attached to the end of cantilever beam 24, as for example by pin connection 39 depicted in FIG. 3.

In using the apparatus of the instant invention, hull 16 is jacked up out of the water until the bottoms of cantilever beams 24 have been raised a sufficient distance above the elevation of platform deck 25, said distance being preferably at least several feet greater than the vertical height of support means 50 and sufficient to clear any buildings or obstructions situated on the platform deck. Then, cantilever beams 24, carrying substructure 34 and drilling module 30 thereon, are skidded outwardly to a position over the platform deck 25, such as shown in FIG. 6. In a preferred embodiment of the invention, cantilever beams 24 are extended to a position such that support means 50, when lowered to platform deck 25, will be located approximately 15 feet, in a horizontal direction, beyond the first well 15*f* to be serviced or drilled by drilling module 30, as depicted in FIG. 6.

After cantilever beams 24 have been laterally extended a desired distance over the platform 22, support means 50 is lowered onto the platform 22, said lowering operation being accomplished by use of winch 37 depicted in FIG. 3 or other suitable means. After being lowered to platform 22, support means 50 is secured to the platform such that columns 52 of the support means are substantially vertical and the tops of said columns, including motion blocks 60, are at an elevation lower than the bottom of the cantilever beams 24. Additionally, support means 50 should be secured to the platform 22 such that when cantilever beams 24 are extended over the support means, the cantilever beams will be aligned with and positioned directly above motion blocks 60, as depicted in FIG. 9.

Support means 50 is secured to platform 22 in any of several known ways, such as by bolting or welding it in place. In the preferred embodiment, girder 51 of support means 50 rests upon and spans the capping beams 26 of platform 22, as shown in FIG. 11. Capping beams 26 ar typically located directly above the upper ends of the legs 27 of the platform, as depicted in FIG. 11, and the upper surface of said capping beams typically extends 8 to 12 inches above the platform deck 25. In the preferred embodiment, diagonal mounting brackets 56 are used to secure girder 51 to capping beams 26, and diagonal sway braces 57 are used to secure the upper ends of vertical columns 52 to capping beams 26, as shown in FIG. 9.

After supporting means 50 has been securely attached to platform 22, cantilever beams 24 are further skidded or otherwise moved laterally away from rig 10 until such time as the centerline 32 of derrick 31 is located over the first well 15*f* to be drilled or serviced, as depicted din FIG. 7.

After cantilever beams 24 have been extended sufficiently such as to position derrick 31 in the desired location over the first well to be drilled or serviced, hull 16 of rig 10 is jacked down until the bottoms of the free ends of cantilever beams 24 rest and are supported on the motion blocks 60 which are located on the tops of vertical columns 52, as shown in FIG. 7. The drilling modules can be operated to service or drill the desired well.

After servicing or drilling the first well, cantilever beams 24 may be moved laterally in an outward or inward direction such that drilling module 30 is positioned at a desired location above the second well to be serviced or drilled. Such movement of cantilever beams 24 may be accomplished by simply skidding or otherwise laterally moving the cantilever beam 24 across the top of support means 50. Such skidding on top of support means 50 is facilitated by the sliding pads 62 of motion blocks 60 which are situated on top of vertical columns 52 or on top of girder 51, as the case may be.

The support means 50 described and used in accordance with the foregoing effectively maximizes the reach of rig 10 and increases the load capacity of the rig at maximum reach. Moreover, the sliding and swiveling action permitted by motion blocks 60 helps to minimize the transmission of lateral and rotational forces between the rig 10 and platform 22. Otherwise, swaying and other motion of rig 10 relative to platform 22 might impose unacceptable loading on platform 22 or rig 10 via support means 50.

Figure 12:
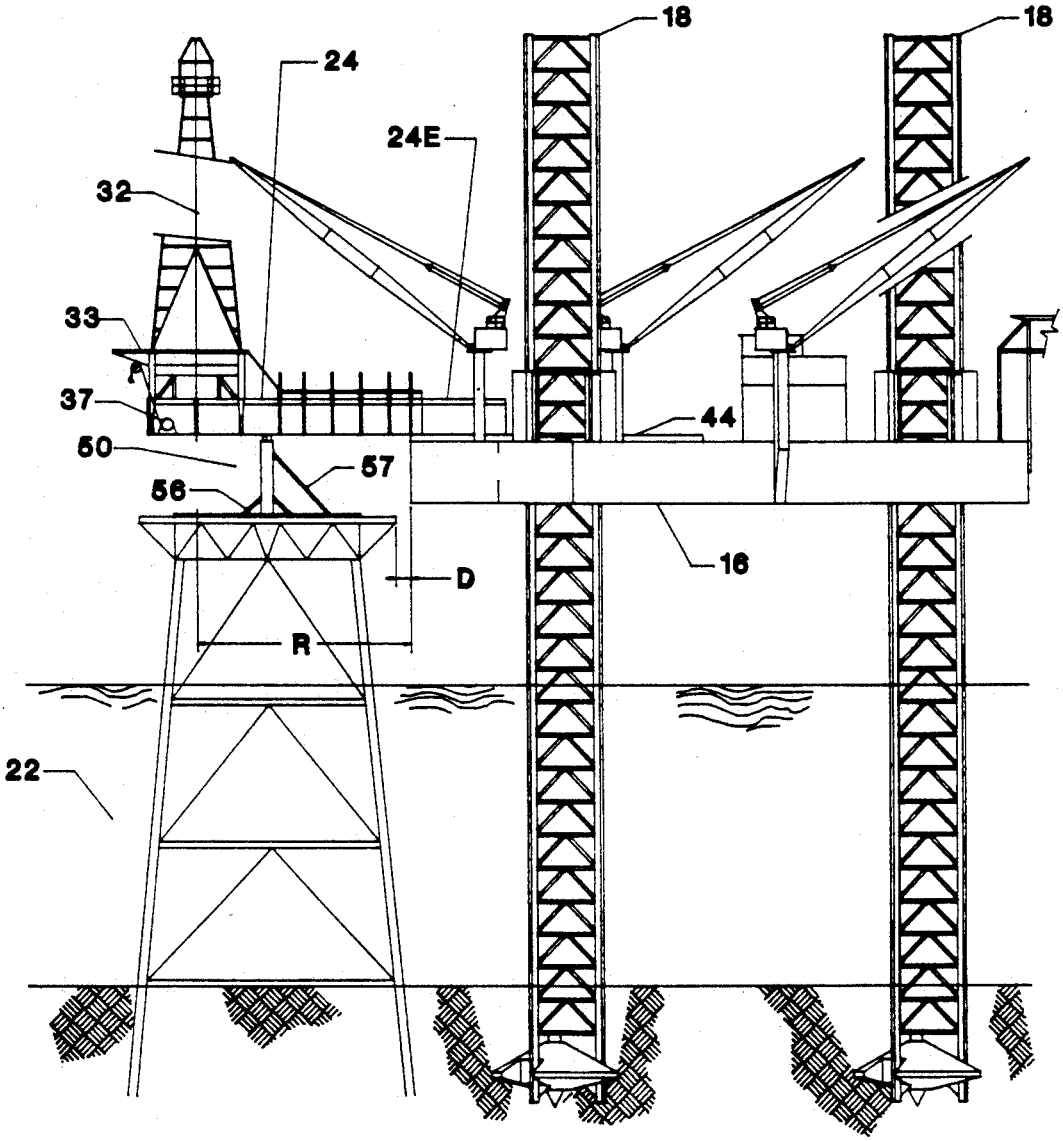
FIG. 12 is an additional view of the rig illustrated in FIG. 7 showing further extension of the cantilever beams and drilling module.

If there is a need or desire to service a well located beyond the reach of cantilever beams 24, extension 24E may be added to the beam as illustrated in FIG. 12. Extension 24E may be secured to cantilever beam 24 in any of several known methods, including the use of the pins, bolts or welding.

When demobilizing the rig, the process described above is reversed, i.e., cantilever beams 24 are withdrawn to their retracted position, support means 50 is disengaged from the platform and returned to an out-of-the-way place on rig 10.

While a specific embodiment of the invention has been shown and described in detailed to illustrate the application of the principles of the invention, it will be understood that the invention may be embodied otherwise without departing from such principles.

What is claimed is:

1. A mobile marine structure for drilling and receiving wells of a platform situated in a body of water above a seabed, said structure comprising:

a floatable hull having at least one beam capable of being extended laterally with respect to said hull;

at least one leg extending from said hull, said leg being capable of movement up and down with respect to the hull, for supporting the hull on the seabed; and means for supporting the beam on the platform when the beam is extended over the platform, said support means including a girder situated on the platform, at least one column extending between the platform and the beam, and means for facilitating motion of the beam relative to the support means.

2. The structure of claim 1 wherein the motion facilitating means includes upper and lower sliding pads located above and below a middle pad, said pads being capable of rotational motion with respect to each other.

3. A mobile marine structure for drilling and servicing wells of a platform situated in a body of water above a seabed, said structure comprising:

a floatable hull having at least one beam which is capable of being extended laterally with respect to said hull, said beam having an unsupported end;

at least one leg extending from said hull, said leg being capable of extending to the seabed for supporting the hull thereon; and means for supporting the unsupported end of the beam on the platform when said unsupported end of the beam is extended over the platform, said support means including a girder situated on the platform and means for facilitating motion of the beam relative to the support means.

4. The structure of claim 3 wherein the support means includes at least one column extending between the platform and the beam.

5. The structure of claim 3 wherein the support means is secured to the platform such that when the unsupported end of the beam is extended over the platform, a motion facilitating means is aligned with and located below a beam.

6. The structure of claim 5 wherein the support means is removably attached to the structure when the beam is in its retracted position and wherein the structure includes means for lowering the support means to the platform.

7. A method of drilling and servicing wells of a platform from a mobile marine structure having a floatable hull situated in a body of water above a seabed, comprising the steps of:

providing the structure with at least one beam which is capable of being extended laterally with respect to the structure, said beam supporting a drilling module thereon;

providing at least one leg extending from the hull, said leg being capable of movement up and down with respect to the hull;

maneuvering the structure within an operationally acceptable distance from the platform;

extending at least one leg of the structure to the seabed and jacking the hull up such that the bottom of the beam is higher than the top of the platform;

providing a means of supporting the beam on the platform and securing said support means to the platform;

providing the support means with means for facilitating motion between the beam and the support means;

moving the beam laterally such that an unsupported end of the beam is positioned over the support means;

jacking down the hull such that the beam is supported on the support means; and operating the drilling module.

8. The method of claim 7 including the additional step of laterally moving the beam across the top of the support means such that the drilling module supported by the beam is positioned above the desired well location.

9. The method of claim 8 including the additional steps of attaching an extension member to the beam and further extending the beam across the top of the support means so as to maximize the reach of the structure.

* * * * *